US006242094B1

(12) United States Patent
Breznak et al.

(10) Patent No.: US 6,242,094 B1
(45) **Date of Patent: *Jun. 5, 2001**

(54) ELECTRICALLY CONDUCTIVE HETEROFIL

(75) Inventors: Robert Anthony Breznak, Berkeley Heights; Joseph Andrew Foldhazy, Avenel; Robert Allen Ritchie, Kenvil; Herman Leslie LaNieve, III, Warren, all of NJ (US); Wolfgang Alfred Piesczek, Bobigen (DE)

(73) Assignee: Arteva North America S.A.R.L., Zurich (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/074,883

(22) Filed: May 8, 1998

Related U.S. Application Data

(62) Division of application No. 08/722,704, filed on Sep. 30, 1996, now Pat. No. 5,916,506.

(51) Int. Cl.[7] ..... D01F 8/00

(52) U.S. Cl. ..... 428/373; 428/370; 428/374; 428/372

(58) Field of Search ..... 428/370, 373, 428/374, 372, 377

(56) References Cited

U.S. PATENT DOCUMENTS

| | | | | |
|---|---|---|---|---|
| H983 | * | 11/1991 | Brown | 264/211.17 |
| 4,255,487 | | 3/1981 | Sanders . | |
| 4,403,094 | * | 9/1983 | Sasaki et al. | 528/308.2 |
| 4,425,393 | * | 1/1984 | Benedyk et al. | 428/95 |
| 4,473,996 | * | 10/1984 | Kueoda et al. | 57/243 |
| 5,439,741 | * | 8/1995 | Gibbon et al. | 425/377 |
| 5,494,620 | * | 2/1996 | Liu et al. | 264/28 |
| 5,776,608 | * | 7/1998 | Asher et al. | 428/373 |
| 5,840,425 | * | 11/1998 | Hodan | 428/372 |
| 5,916,506 | * | 6/1999 | Breznak et al. | 264/104 |
| 5,952,099 | * | 9/1999 | Asher et al. | 428/370 |

FOREIGN PATENT DOCUMENTS

| | | | |
|---|---|---|---|
| 0 160 320 A2 | 11/1985 | (EP) | D01F/8/04 |
| 0 407 960 A2 | 1/1991 | (EP) | D01F/8/04 |
| 1 391 262 | 4/1975 | (GB) | D06M/11/00 |
| 1 417 394 | 12/1975 | (GB) | D06M/11/00 |

OTHER PUBLICATIONS

Patent Abstracts of Japan, vol. 007, No. 147 (C–173), Jun. 28, 1983 & JP 58 060015A (Teijin KK), Apr. 9, 1983.

Patent Abstracts of Japan, vol. 096, No. 002, Feb. 29, 1996 & JP 07 278956A (Toray Ind Inc; Others: 01) Oct. 24, 1995.

Patent Abstracts of Japan, vol. 014, No. 014, No. 382, (C–0749) Aug. 17, 1990 & JP 02 139445A (Toray Ind Inc), May 29, 1990.

Patent Abstracts of Japan, vol. 011, No. 030, (C–400) Jan. 29, 1987 & JP 61 201008A (Toray Monofilmanet Co Ltd), Sep. 5, 1986.

Database WPI, Section Ch, Week 8341, Derwent Publications Ltd., London, GB; Class A17, AN 83–786588, XP002048254 & JP 58 149 329A (Teijin Ltd), Sep. 5, 1983.

Database WPI, Section Ch, Week 9621, Derwent Publications Ltd., London, GB; Class A23, AN 96–206071, XP002048255 & JP 08 074 125 A (Toray Ind Inc), Mar. 19, 1996.

Database WPI, Section Ch, Week 7623, Derwent Publications Ltd., London, GB; Class A94, AN 76–42950X, XP002048256 & JP 51 047 200A (Mitsubishi Rayon Co Ltd), Apr. 22, 1976.

* cited by examiner

*Primary Examiner*—N. Edwards
(74) *Attorney, Agent, or Firm*—Gregory N. Clements

(57) ABSTRACT

An antistatic bicomponent fiber comprises a nonconductive first component made of a first polymer and a conductive second component made of a second polymer containing a conductive material, where the second polymer has a lower melting point than the first polymer. The bicomponent fiber is made by co-extruding the two polymers at a temperature above their melting points, stretching the extruded fiber to increase the tensile strength, and heat treating the fiber at a temperature between the melting point of the first polymer and the melting point of the second polymer to improve the conductivity of the conductive second component. The bicomponent fiber is preferably a sheath/core fiber.

14 Claims, No Drawings

ELECTRICALLY CONDUCTIVE HETEROFIL

This is a division of application Ser. No. 08/722,704 filed Sep. 30, 1996 now U.S. Pat. No. 5,916,506.

BACKGROUND OF THE INVENTION

This invention relates to the field of electrically conductive fibers, especially antistatic fibers comprising polymeric materials, and a means for making same.

In many applications where fibrous materials are used, static electricity is often problematic. For example, in laybelt applications, where monofil fibers are often used, or in carpeting, where multiple yarns are frequently preferred, friction often produces static charges that interfere with the use or enjoyment of the material. Static electricity can cause a spark discharge of a static electrical charge that has built up, usually as a result of friction, on the surface of a non-conductive material. A material having a sufficient amount of electrical conductivity, i.e. low electrical. resistivity, to dissipate an electrical charge without a spark discharge would not exhibit problematic static electricity.

U.S. Pat. No. 3,969,559 teaches a textile antistatic strand comprising a thermoplastic polymer in which carbon black is uniformly dispersed to provide conductivity. The antistatic strand is partially encapsulated by another, non-conductive, thermoplastic polymer constituent. The electrical conductivity decreases as the tenacity of the fiber increases with increased draw and hot roll temperature.

U.S. Pat. No. 4,185,137 teaches a conductive sheath/core heterofilament having a thermoplastic polymer core in which is dispersed a material selected from the group consisting of zinc oxide, cuprous iodide, colloidal silver, and colloidal graphite.

U.S. Pat. No. 4,255,487 teaches an electrically conductive textile fiber comprising a polymer substrate which contains finely divided electrically conductive particles in the annular region at the periphery of the fiber.

U.S. Pat. No. 4,610,925 teaches an antistatic hairbrush filament having a nylon or polyester core and a compatible polymeric sheath containing carbon.

U.S. Pat. No. 3,803,453 teaches a synthetic filament comprising a continuous nonconductive sheath of synthetic polymer surrounding a conductive polymeric core containing carbon.

Although it is known to make conductive or antistatic polymeric fibers by including conductive particles, when such fibers are drawn to increase the strength of the fiber or orient the polymer molecules the conductivity is significantly reduced or eliminated.

SUMMARY OF THE INVENTION

The present invention is a polymeric antistatic bicomponent fiber comprised of a nonconductive component which comprises a first polymer and a conductive component which comprises a second polymer containing a conductive material at a level of at least 3% by weight. The conductive component has a resistivity of no more than about $10^8$ ohm cm. The second polymer has a melting point of at least 180° C., and preferably at least 200° C. The first polymer melts at a temperature at least 20 C. higher than the second polymer and preferably at least 30° C. higher. The two components are each a continuous length of polymer which together make up a fiber which typically has a circular cross-section, though other cross-sections can also be made and are within the scope of the invention. The two components can be in a side-by-side or sheath-core arrangement with respect to one another. The two components adhere to each other sufficiently well that the two components do not separate from one another. The first component comprises about 50% to about 85% by weight of the fiber, and the second component about 15% to about 50% of the fiber. The bicomponent fiber is preferably in the form of a sheath-core fiber, having a non-conductive core made of the first polymer and a conductive sheath made of the second polymer, which contains a conductive material at a level of at least 3% by weight. The conductive sheath has a resistivity of no more than about $10^8$ ohm cm. The fiber can be used as part of a multifilament yarn or can be used as a monofil. It can be used as a continuous filament or chopped into staple. The preferred fiber is a monofil having a diameter of at least 0.1 mm and preferably at least 0.25 mm.

A process for making such a fiber comprises the following steps: (1) co-extruding the first polymer and the second polymer, which contains a conductive material, at a temperature above the melting point of the first polymer to form a bicomponent fiber, which preferably is a sheath/core fiber, in which the core is made up of the first polymer and the sheath is made up of the second polymer; (2) stretching the fiber at a temperature below the melting point of the second polymer to form a stretched fiber with improved tensile properties; and (3) heat treating the stretched fiber at a temperature between the melting point of the first polymer and the melting point of the second polymer. Preferably, the lower melting polymer (the second polymer) has a melting point of at least 180° C., and preferably at least 200° C. The two melting points are at least 20° C. apart, and preferably at least 30° C. apart. Conductivity decreases or is lost when the fiber is stretched, apparently due to the disruption of the conductive sheath. The conductivity is partially or fully restored during the heat treatment.

It is an object of the present invention to provide an antistatic polymeric fiber having tensile properties comparable to ordinary polymeric fibers.

It is also an object of the present invention to provide a fiber having a nonconductive core containing a first polymer and a conductive sheath containing a second polymer.

It is a further object of the present invention to provide a novel process for making an antistatic polymeric fiber having a nonconductive core containing a first polymer and a conductive sheath containing a second polymer.

It is also an object of the present invention to provide a fiber having the tensile properties of a drawn, oriented polyester fiber and a resistivity in the sheath layer of no more than $\mathbf{10}^8$ ohm cm.

Other objects and advantages of the present invention will be apparent to those skilled in the art from the following description and the appended claims.

DESCRIPTION OF THE PREFERRED EMBODIMENTS

In one preferred embodiment of the present invention, poly(ethylene terephthalate) ("PET") is chosen as the core polymer and carbon-filled poly(butylene terephthalate) ("PBT") is selected as the conductive sheath polymer. The PBT contains at least 3%, and preferably about 5% to about 15% by weight carbon particles (powder and/or fiber). These polymers are commercially available in a molecular weight suitable for fiber formation. The polymers are coextruded from a heterofil spinneret at a temperature of about 270° C. to about 290° C. to form a sheath/core fiber, which comprises a core of PET and a sheath of carbon-filled PBT.

The extruded sheath/core fiber has sufficient conductivity to provide antistatic properties. The fiber is then drawn to about four times its initial (as-extruded) length to increase its tensile strength, causing a loss of conductivity. Subsequently, the fiber is heat treated at about 240° C., restoring the conductivity. The heat treatment time is typically less than one minute, and can be selected by experimentation to give a desired conductivity, since the conductivity increases with increasing heat treatment time.

PET and PBT adhere well together because they are partially miscible. They have approximate melting temperatures of 265° C. and 235° C., respectively. These characteristics make these polymers wellsuited for use together in the present invention. The conductive PET/PBT fiber has an excellent combination of properties, including relatively high strength, low shrinkage, and low density. The high tensile strength and low shrinkage are characteristic of a drawn PET fiber. The sheath provides antistatic properties, while the strength of the PET core is retained. Tensile properties as measured by ASTM Method D-2256 are typically as high or higher than about 2 gpd tenacity and 40 gpd modulus, preferably higher than about 3 gpd tenacity and 50 gpd modulus.

In the practice of this invention, it is important to select two polymers that adhere to each other sufficiently to form a good bicomponent (sheath/core) fiber. It is also important that the lower melting sheath polymer does not degrade significantly under the processing conditions, particularly when co-extruded at a temperature above the melting point of the core polymer. It is generally desirable to choose a sheath polymer that has a melting point of at least about 180° C.

To obtain a fiber that has good orientation and/or tensile properties, it is necessary that the heat treatment does not melt the core polymer. Consequently, a melting point difference of at least 20° C. between the two polymers is desirable, and preferably at least 30° C.

Although PET and PBT are specifically mentioned herein, other suitable polymer pairs can also be used in the practice of this invention. Examples include PET with other polyesters such as polyethylene terephthalate/adipate copolymer or polyethylene terephthalate/isophthalate copolymer. Furthermore, polymers other than polyesters may be used in the practice of this invention, such as PET paired with nylon 11 or nylon 12. Those skilled in the art will readily be able to determine whether two polymers are suitable in the practice of this invention without undue experimentation, based on the teachings herein.

The sheath polymer must have distributed therethrough an amount of one or more conductive materials such as graphite and/or metal particles, that provides sufficient conductivity to allow static electricity to dissipate without spark discharge. Generally, a resistivity of no more than about $10^8$ ohm cm, e.g. in the range of about $10^3$ to about $10^8$ ohm cm, is suitable for the sheath of the sheath-core fiber. Lower Festivities may also be obtained, if desired. Although an amount of about 5% to about 15% by weight has been found suitable for carbon or graphite particles in a polymer matrix, the amount may be more or less than this depending on the conductive particles, the polymer, and other factors. The conductive particles are included in amounts that are sufficient to provide antistatic properties, but not so much that the sheath polymer is no longer suitable as a fiber sheath due to overloading, which results in loss of physical integrity. The core polymer will generally comprise about 85% to about 50% by weight of the sheath/core fiber, and preferably about 80% to about 70%, with the balance being the sheath.

Although the fiber is stretched to about four times its initial length in the preferred embodiment described above, other stretching ratios may be desirable, especially if different polymers are used. Generally, the fiber should be stretched until it has achieved the desired tensile properties, according to common practice in the art. The loss of conductivity that occurs in the sheath due to the drawing step is then corrected by the heat treating step.

The following non-limiting examples illustrate selected embodiments of the present invention.

EXAMPLE 1

PET was chosen as the core polymer and carbon-loaded PBT was selected as the conductive sheath polymer. The PET had an intrinsic viscosity of about 0.9 dl/g. The PBT was a commercial conductive polymer from LNP Corp, sold under the name STAT-KON W™, and contained about 8% by weight carbon particles. The carbon-filled PBT melts at about 235° C., compared with PET, which melts at about 265° C. The polymers were thoroughly dried before spinning. The polymers were co-extruded at about 280° C. through a heterofil spinneret having a 3 mm diameter to make a 0.5 mm drawn fiber. The fiber was extruded horizontally into a water bath having a temperature of about 42° F. The water bath temperature was lower than normally used for PET to prevent crystallization of the PBT. The wind-up speed was about m/min. The weight ratio of filled PBT sheath to PET core was about 30:70. The as-extruded sheath/core fiber had an electrical resistance of about 160,000 ohm/cm. The fiber was then drawn to four times its initial length at a temperature of 90° to increase its tensile strength, resulting in an increase in the resistance to more than 10 million ohm/cm. Subsequently, the drawn fiber was heated to 240° C. by passing it through a meter oven at a speed of 24 m/minute. The air velocity was 600 m/minute. This corresponds to a residence time of 0.21 minute. A longer residence time results in a lower resistance. The residence time was chosen to give a resistance of about 160,000 ohms/cm after heat treatment. This is the same as the resistance before drawing. The fiber had also relaxed (shrunk) by about 2%. The drawn heat-treated fiber had the following tensile properties: 3.5 gpd tenacity and 36% elongation. The sheath portion of the fiber had a resistivity of 94 ohm cm.

The heat-treated fiber exhibited anti-static properties, resistance to abrasion, high strength, and low density. The adhesion between core and sheath were excellent, and the fiber was flexible.

EXAMPLE 2

A polyethylene terephthalate/adipate copolymer having a terephthalate to adipate mole ratio of about 85:15 and melting at about 226° C. was made by standard polymerization methods and was compounded in a twin screw compounder with 10% by weight of extraconductive carbon black, sold as PRINTEX™XE2 by Degussa. The filled polymer was pelletized, dried and fed into a bicomponent fiber spinning machine as the sheath over a concentric polyethylene terephthalate core. The sheath comprised about 25% by weight of the fiber. The resulting asspun fiber was 1 mm in diameter and had an electrical resistance of 2500 ohms/cm and a tensile strength of 0.28 gpd at 2% elongation. After hot drawing at a ratio of 4.4:1 and a temperature of 100° C., the resistance was $10^8$ ohms/cm, and the tensile strength was 2.6 gpd at elongation of 34%. After relaxing by 2% at 240° C., the resistance was 22,000 ohms/cm, and the tensile strength was 3.1 gpd at 51% elongation. The sheath portion of the fiber had a resistivity of about 10 ohm cm.

EXAMPLE 3

A sheath/core fiber was made using the same process as in Example 2, except that the fiber was made on a larger scale in a commercial fiber spinning facility. The weight ratio of poly(ethylene terephthalate) to conductive polymer was 70:30 in these experiments. The process was run to packages for more than an hour through a 20 hole by 1.4 mm spinneret. The fiber was quenched in water at 45° C. and then drawn at 90° to a draw ratio of 4.4:1. The fiber was then annealed in a 260° C. oven for about 4 seconds, resulting in relaxation (shrinkage) of about 2%. The diameter of the monofil was about 0.40mm. The fiber had the following tensile properties, as measured by ASTM Method D-2256:

59 gpd modulus, 2.6 gpd tenacity, 49% elongation. The fiber had a resistance of 50,000 ohms/cm. The hot air shrinkage at 180° C. was 3%.

A duplicate experiment was run with the same polymers but with a draw ratio of 5:1 at 90° C., followed by 2% relaxation in a 260° C. oven for about 4 seconds. The fiber had a diameter of about 0.4mm. The tensile properties were: 63 gpd modulus, 3.3 gpd tenacity, 31% elongation. The hot air shrinkage was 3% at 180° C. The resistance was 50,000 ohms/cm.

The outside of the fiber was not as smooth as the outside of the fiber from Example 2, probably because the polymer in Example 2 was filtered, whereas the polymer in Example 3 was not filtered. The fibers in Example 3 had a higher resistance than the fibers in Example 2, probably because the fibers in Example 2 were annealed for a longer time.

EXAMPLE 4

A poly(ethylene terephthalate-isophthalate) copolymer is compounded with 8% by weight PRINTEX™XE2 carbon black to make a conductive compound. The compound is coextruded with PET to make a sheath/core polymer with the PET in the center and the conductive layer on the outside. The as-spun fiber is drawn at a ratio of 4.4 and a temperature of approximately 100°. The resistance of the fiber is high at this point. The fiber is then annealed at a temperature between the melting point of PET and the melting range of poly(ethylene terephthaiate/isophthalate). The annealed fiber has electrical resistance of 90,000 ohms/cm.

It is to be understood that the above described embodiments are illustrative only and that modification throughout may occur to one skilled in the art. Accordingly, this invention is not to be regarded as limited to the embodiments described herein.

What is claimed is:

1. A polymeric antistatic bicomponent sheath-core fiber which comprises about 50% to about 85%, by weight of the fiber, of a non-conductive core of polyethylene terephthalate and about 15% to about 50%, by weight of the fiber, of a conductive sheath of a second polymer containing about 5% to about 15% by weight of electrically conductive particles and having a resistivity of no more than about $10^8$ ohm cm, said polyethylene terephthalate having a melting point at least 20° C. higher than said second polymer, and said second polymer having a melting point of at least 180° C. and being selected from the group consisting of poly (butylene terephthalate), polyethylene terephthalate/adipate copolymer, polyethylene terephthalate/isophthalate copolymer, nylon 11 and nylon 12, and said electrically conductive particles being carbon and/or metal particles.

2. A bicomponent fiber according to claim 1 wherein the polyethylene terephthalate has a melting point at least 30° C. higher than the second polymer.

3. A bicomponent fiber according to claim 1 wherein the polyethylene terephthalate has a melting point at least 30° C. higher than the second polymer.

4. A bicomponent fiber according to claim 1 wherein the second polymer is poly(butylene terephthalate), polyethylene terephthalate/adipate copolymer or polyethylene terephthalate/isophthalate copolymer.

5. A bicomponent fiber according to claim 1 wherein the second polymer is poly(butylene terephthalate), polyethylene terephthalate/adipate copolymer or polyethylene terephthalate/isophthalate copolymer.

6. A bicomponent fiber according to claim 2 wherein the second polymer is poly(butylene terephthalate), polyethylene terephthalate/adipate copolymer or polyethylene terephthalate/isophthalate copolymer.

7. A fiber according to claim 1 wherein the electrically conductive particles are graphite.

8. A fiber according to claim 1 wherein the second polymer has a melting point of at least 200° C.

9. A fiber according to claim 1 wherein the core comprises about 70% to about 80% by weight of the fiber and the second component comprises the balance.

10. A bicomponent fiber according to claim 9 which comprises a core of poly(ethylene terephthalate) and a sheath of carbon filled poly(butylene terephthalate).

11. A bicomponent fiber according to claim 9 wherein the second polymer is poly(butylene terephthalate).

12. A bicomponent fiber according to claim 1 which comprises a core of poly(ethylene terephthalate) and a sheath of carbon filled poly(butylene terephthalate).

13. A bicomponent fiber according to claim 1 wherein the second polymer is poly(butylene terephthalate).

14. A bicomponent fiber according to claim 1 having a resistance in the range 22,000 to 160,000 ohms/cm.

* * * * *